US011220101B2

(12) United States Patent
Schaede et al.

(10) Patent No.: US 11,220,101 B2
(45) Date of Patent: Jan. 11, 2022

(54) DRYING UNIT FOR DRYING PRINTED SUBSTRATES

(71) Applicant: KOENIG & BAUER AG, Würzburg (DE)

(72) Inventors: Johannes Schaede, Würzburg (DE); Robert Stierman, Alphen aan den Rijn (NL)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/276,552

(22) PCT Filed: Oct. 22, 2019

(86) PCT No.: PCT/EP2019/078622
§ 371 (c)(1),
(2) Date: Mar. 16, 2021

(87) PCT Pub. No.: WO2020/108864
PCT Pub. Date: Jun. 4, 2020

(65) Prior Publication Data

US 2021/0323300 A1 Oct. 21, 2021

(30) Foreign Application Priority Data

Nov. 29, 2018 (DE) ..... 10 2018 130 280.0

(51) Int. Cl.
*B41F 23/04* (2006.01)
*B41F 9/02* (2006.01)

(52) U.S. Cl.
CPC ..... *B41F 23/0453* (2013.01); *B41F 9/021* (2013.01); *B41F 23/0486* (2013.01)

(58) Field of Classification Search
CPC ..... B41F 23/0486
(Continued)

(56) References Cited

U.S. PATENT DOCUMENTS 3,431,139 A * 3/1969 Joachim ..... B65H 3/46 427/372.2
9,738,472 B2 * 8/2017 Rothaug ..... B41F 21/10
(Continued)

FOREIGN PATENT DOCUMENTS

DE 197 04 284 10/1998
DE 198 57 984 6/2000
(Continued)

OTHER PUBLICATIONS

International Preliminary Report on Patentability for PCT/EP2019/078622 dated Oct. 13, 2020, 11 pages.
(Continued)

*Primary Examiner* — Anthony H Nguyen
(74) *Attorney, Agent, or Firm* — Nixon & Vanderhye P.C.

(57) ABSTRACT

The invention relates to a drying unit (22) for drying printed substrates (21), comprising a chamber (23) with a gaseous medium which is oxygen-reduced by means of an inert gas, wherein the substrates (21) are guided through the chamber (23) or at least can be guided through the chamber, and the chamber (23) has an entrance for the substrates (21) to be guided into the chamber (23) in the transport direction (T) of the substrates (21). The entrance for the substrates (21) to be guided into the chamber (23) is formed by two cylinders (04; 06) which are positioned against each other longitudinally. The cylinders (04; 06) positioned against each other at the entrance of the chamber (23) form a printing unit (03). One of the cylinders (04) is designed as a printing cylinder (04), and the other cylinder (06) is designed as a cylinder (06) which interacts with the printing cylinder (04) and applies a printed image onto the affected substrates (21). The two cylinders (04; 06) which are positioned against each other under pressure at the entrance of the chamber (23) form a seal which runs axially to the cylinders (04; 06) for preventing the oxygen-reduced gaseous medium from leaking
(Continued)

Figure 1:
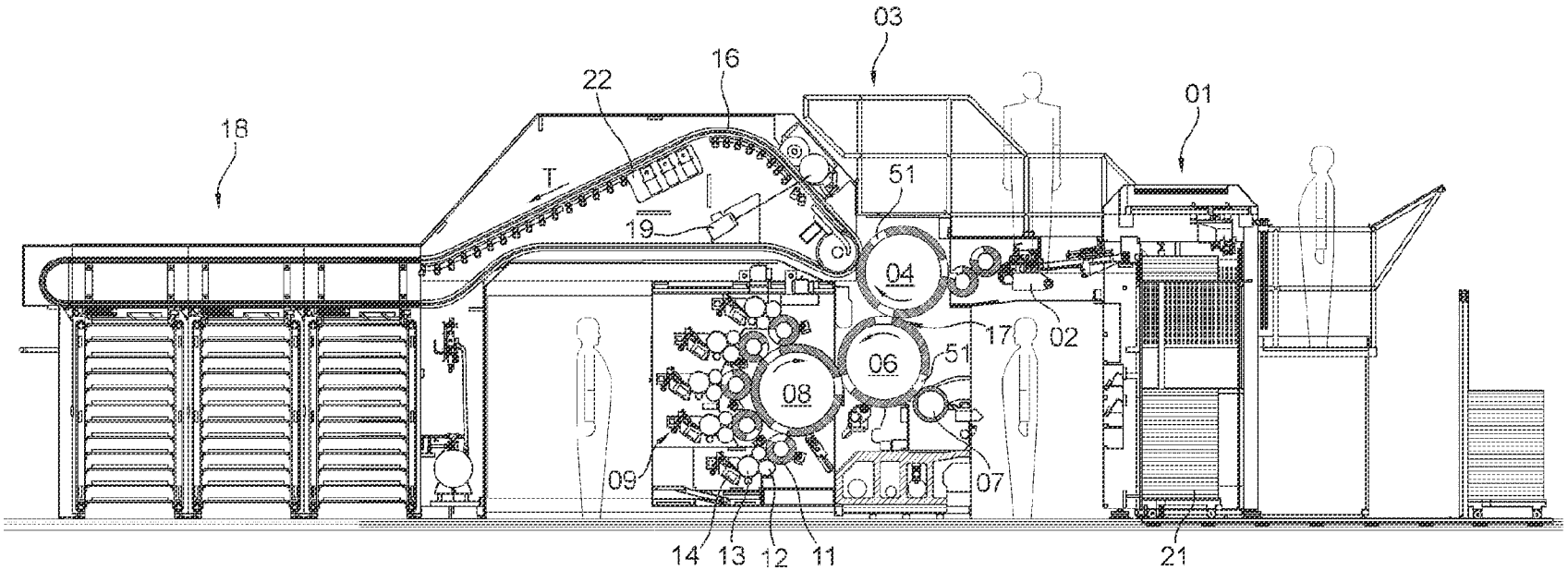

out of the chamber (23) and/or for preventing oxygen from the ambient air from entering the chamber (23). The printing unit (03) arranged at the entrance of the chamber (23) is designed as a printing unit (03) for an intaglio printing process.

13 Claims, 8 Drawing Sheets

(58) Field of Classification Search
USPC ..... 101/424.1
See application file for complete search history.

(56) References Cited

U.S. PATENT DOCUMENTS

| | | | | |
|---|---|---|---|---|
| 9,889,644 | B2 * | 2/2018 | Hachmann | B41J 2/2146 |
| 2011/0205321 | A1 * | 8/2011 | Kobayashi | B41J 2/155 347/102 |
| 2014/0299448 | A1 * | 10/2014 | Maul | B41F 23/0453 198/617 |
| 2015/0246525 | A1 * | 9/2015 | Maul | B41F 23/0406 101/424.1 |
| 2016/0271933 | A1 * | 9/2016 | Feygelman | B41F 19/001 |

FOREIGN PATENT DOCUMENTS

| | | |
|---|---|---|
| DE | 100 83 500 | 1/2002 |
| DE | 101 41 755 | 3/2002 |
| DE | 10 2006 032 679 | 1/2008 |
| DE | 10 2015 116 491 | 3/2016 |
| DE | 10 2016 200 544 | 12/2016 |
| EP | 0 830 217 | 11/1999 |
| EP | 1 995 062 | 11/2008 |
| EP | 2 982 510 | 2/2016 |
| EP | 2 987 634 | 2/2016 |
| JP | 4-145400 | 5/1992 |
| WO | 03/020522 | 3/2003 |
| WO | 2005/097927 | 10/2005 |

OTHER PUBLICATIONS

International Search Report for PCT/EP2019/078622 dated Dec. 17, 2019, 7 pages.
Written Opinion of the ISA for PCT/EP2019/078622 dated Dec. 17, 2019, 8 pages.

* cited by examiner

DRYING UNIT FOR DRYING PRINTED SUBSTRATES

This application is the U.S. national phase of International Application No. PCT/EP2019/078622 filed Oct. 22, 2019 which designated the U.S. and claims priority to DE Patent Application No. 10 2018 130 280.0 filed Nov. 29, 2018, the entire contents of each of which are hereby incorporated by reference.

The invention relates to a drying unit for drying printed substrates according to the preamble of claim 1.

A drying system for irradiation drying of paints and/or lacquers and/or coatings on substrates in printing and/or coating machines is known from DE 101 41 755 A1, consisting of a radiator module and an inerting chamber, wherein the inerting chamber consists of a base body, a nozzle system, lateral sealing elements and an inlet and an outlet element; the lateral sealing elements and the outlet element seal the inerting chamber against the sheet guiding cylinder, and the inlet element seals the inerting chamber against the cylinder gap between the sheet guiding cylinder and the cylinder upstream of the drying system when seen in the paper running direction, and a region permeable for the drying radiation is formed on the base body of the inerting chamber. For the drying processes, UV radiators or so-called Excimer UV radiators can be used as the radiator. Nitrogen is often used as the inert gas. With the target inerting, the remaining amount of oxygen is to be lowered to a value below one percent, if possible.

A drier working with Excimer radiators for drying and/or curing lacquers and/or paints on sheets in sheet printing machines is known from DE 198 57 984 A1, wherein the drier is allocated to the sheet conveyed on a sheet guiding cylinder along the sheet conveying path, and at least one Excimer radiator and at least one inert gas blower is surrounded by a bell, wherein the bell consists of lateral parts allocated to the sheet guiding cylinder on both sides and an upper region extending across the width of the sheet conveying path with an inlet and outlet part, and the bell encloses the interior chamber with the sheet guiding cylinder and with at least one further cylinder.

A printing unit without printing plates in a hybrid sheet offset printing machine for personalised printing of the printing sheets to be processed is known from EP 2 982 510 A1, wherein at least one inkjet printing head is integrated in a printing mechanism, in a lacquer mechanism, in an abutment region and/or in an outlay region of the hybrid sheet offset print machine, wherein, in the hybrid sheet offset print machine, printing sheets are printed in the offset printing process with a static single-coloured or multi-coloured printed image and according to the inkjet print method with a variable personalisation printed image, wherein a modular printing unit is provided which has at least one inkjet printing head and whose construction is variable, wherein the modular printing unit is formed from further module units in terms of its functional construction, and wherein the module units are selected and arranged in the hybrid sheet offset print machine so as to be able to be configured and positioned depending on a printing task posed and one or more selectable frame conditions at least by means of a parameter set from the predetermined printing subject, the quantity of editions to be printed, quality requirements of the printing, printing materials, coating materials, drying conditions.

A device for curing a printing ink, lacquer, adhesive or silicon layer is known from EP 0 830 217 B1, with which a substrate made of paper, plastic, glass, wood or metal is coated, having a housing which is open in the direction of a transport body transporting the substrate and which covers the substrate by maintaining substrate inlet and substrate outlet gaps, and having a UV lamp arranged inside the housing with a reflector, which directs the UV light towards the substrate passing through, wherein at least one flushing gas line is connected to a flushing gas source, on the one hand, and to the interior space of the housing, on the other hand, via a nozzle, wherein flushing gas nozzles that can be cooled with water are preferably provided close to the substrate inlet gap and the substrate outlet gap, the current direction angle of which can be set in relation to the substrate passing through and which is in current connection with a gas flow direction and quantity regulator, wherein a tempering device is provided to cool the substrate passing through, wherein the flushing gas nozzles are provided on the lateral walls of the housing, and wherein cooling channels or grooves are arranged in the housing, the reflector and the transport body.

An electron beam device arranged in a sheet printing machine for drying inks applied to printing sheets is known from JP H04-145400 A, wherein the drying chamber is filled with an inert gas (nitrogen).

An inerting device for radiator devices for drying and/or curing paints and/or lacquers within printing machines is known from DE 197 04 284 A1, wherein, in particular for sheet printing machines with Excimer radiators and blowing nozzles arranged inside the inerting chamber, wherein the blowing nozzles are formed to be able to be regionally restricted and/or switched off across the width of the printed material web, and a control device detecting the front and rear edge of the printing material and controlling blowing nozzles and/or Excimer radiators is superordinate to the blowing nozzles and/or Excimer radiators.

A method for printing is known from WO 2005/097927 A1 in which a printing ink is printed onto a substrate using an intaglio printing machine, in which the printing ink is cured after printing, in which the curing is carried out e.g. by an electron beam. This method is used e.g. to produce banknotes.

A method for producing a security element for a security paper, document of value or similar having a substrate is known from DE 10 2006 032 679 A1, wherein the substrate is at least partially equipped with a coating comprising at least two layers, having the following steps:

a) applying a first layer to the substrate, b) applying at least one second layer to the first layer, wherein complete curing of the first layer is not carried out before applying the second layer, c) embossing at least one layer of the coating, d) curing the coating, wherein applying the layers is carried out e.g. using a printing method, in particular gravure printing, flexographic printing or offset printing, wherein curing the layers is carried out e.g. by means of ultraviolet radiation and/or by means of electron radiation.

A device for treating a sheet-like substrate is known from DE 10 2016 200 544 A1, having a sheet guiding cylinder and an inerting device allocated to the sheet guiding cylinder, wherein the sheet guiding cylinder has first holding means for holding the front edge of the substrate, and second holding means are provided which hold the substrate on the sheet guiding cylinder in a region spaced apart from the front edge of the substrate, and wherein the substrate guided by the sheet guiding cylinder can be supplied with inert gas, wherein a third holding means is arranged outside the periphery of the sheet guiding cylinder.

The object of the invention is to create a drying unit for drying printed substrates, wherein the drying unit is suitable for as high a printing speed as possible in a printing machine in an industrial production process.

According to the invention, the object is solved by the features of claim 1. The dependent claims show advantageous embodiments and/or developments of the solution found.

The advantages that can be obtained using the invention consist, in particular, of the drying unit of the printing machine being suitable for as high a printing speed of the printing machine as possible in an industrial production process. Further advantages can be seen in the exemplary embodiments described.

Exemplary embodiments of the invention are depicted in the drawings and are described below in more detail.

Figure 2:
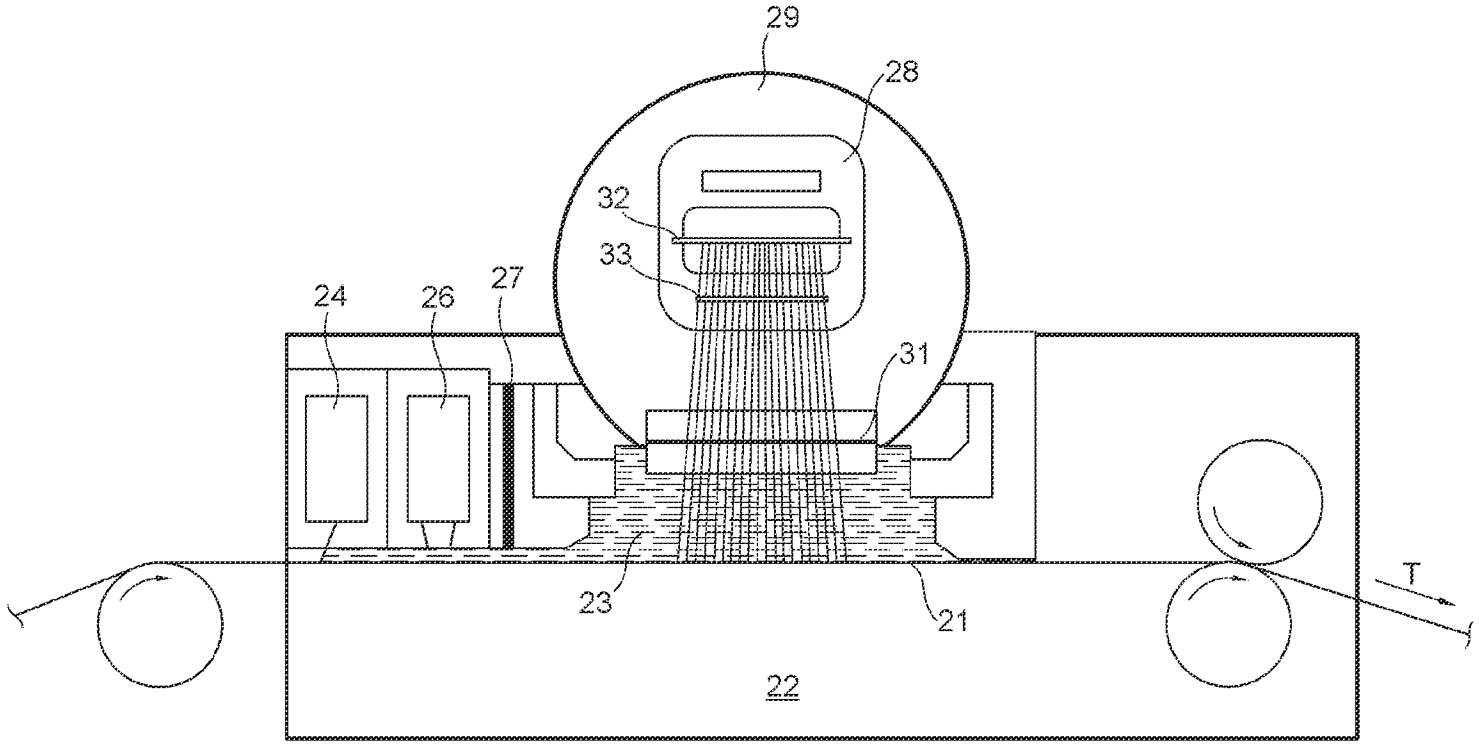
Figure 3:
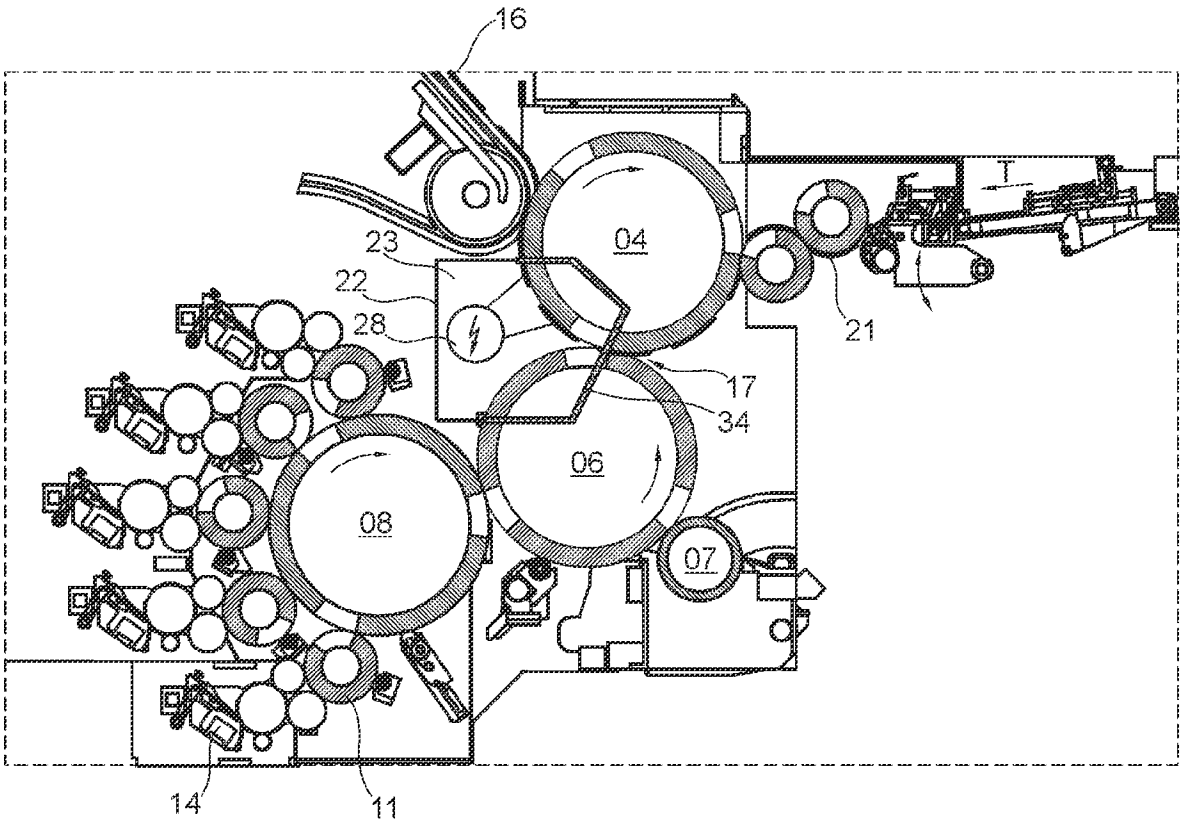
Figure 4:
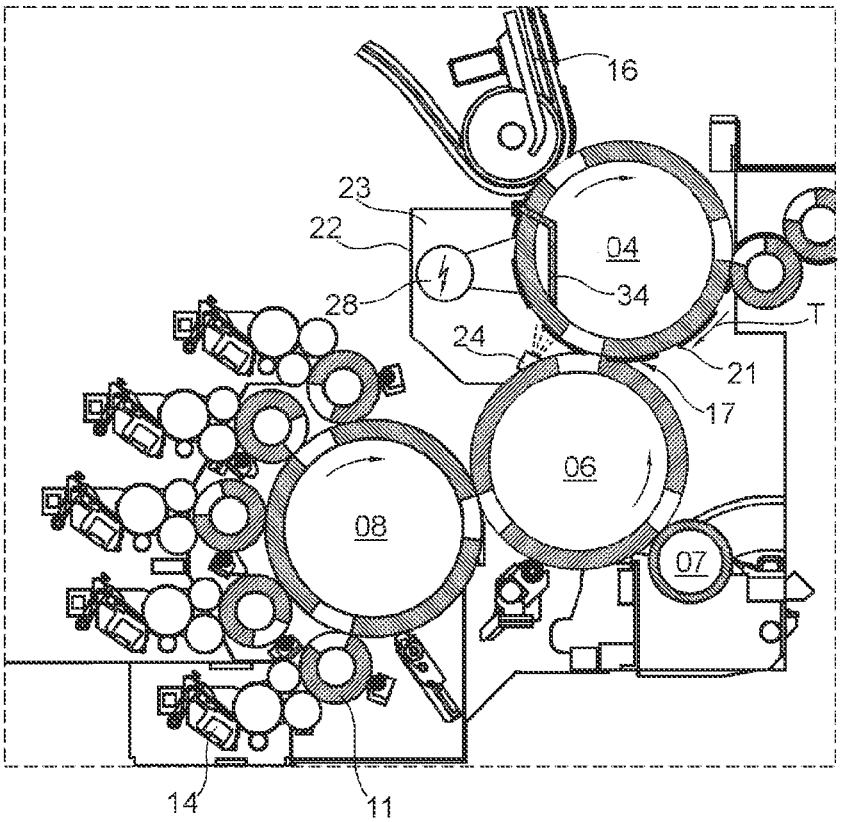
Figure 5:
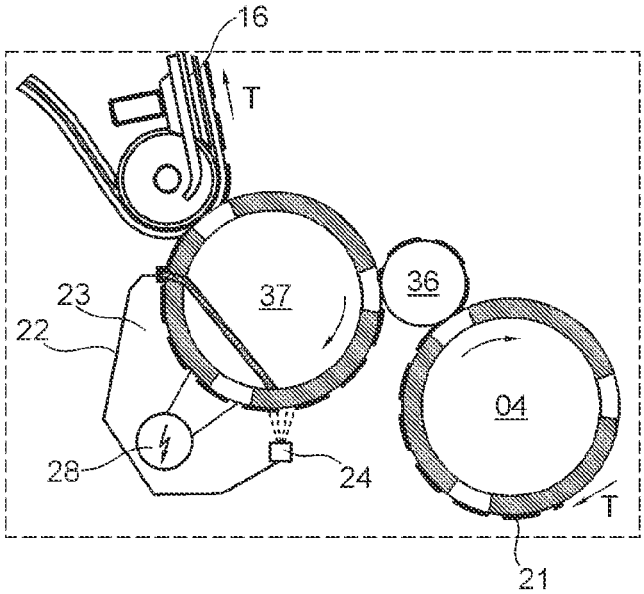
Figure 6:
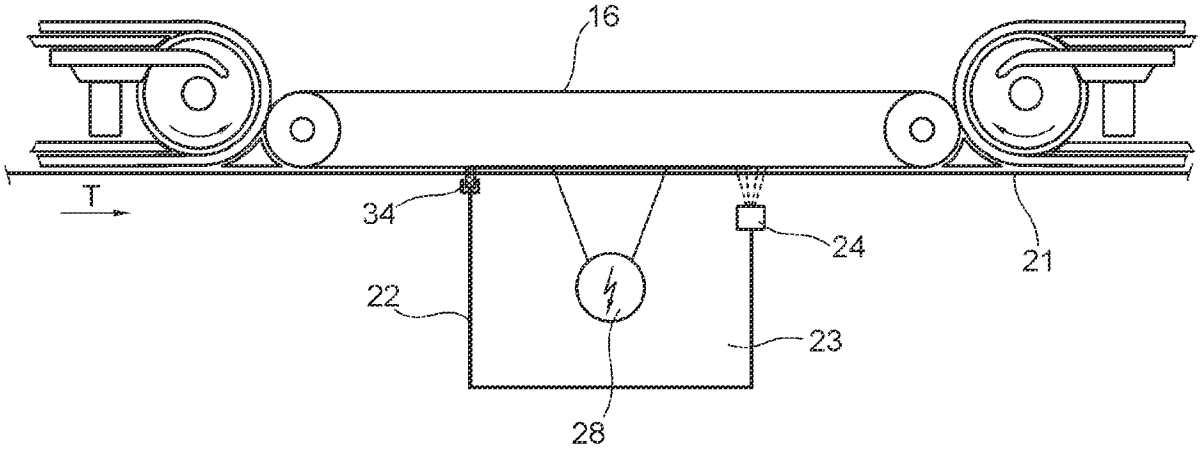
Figure 7:
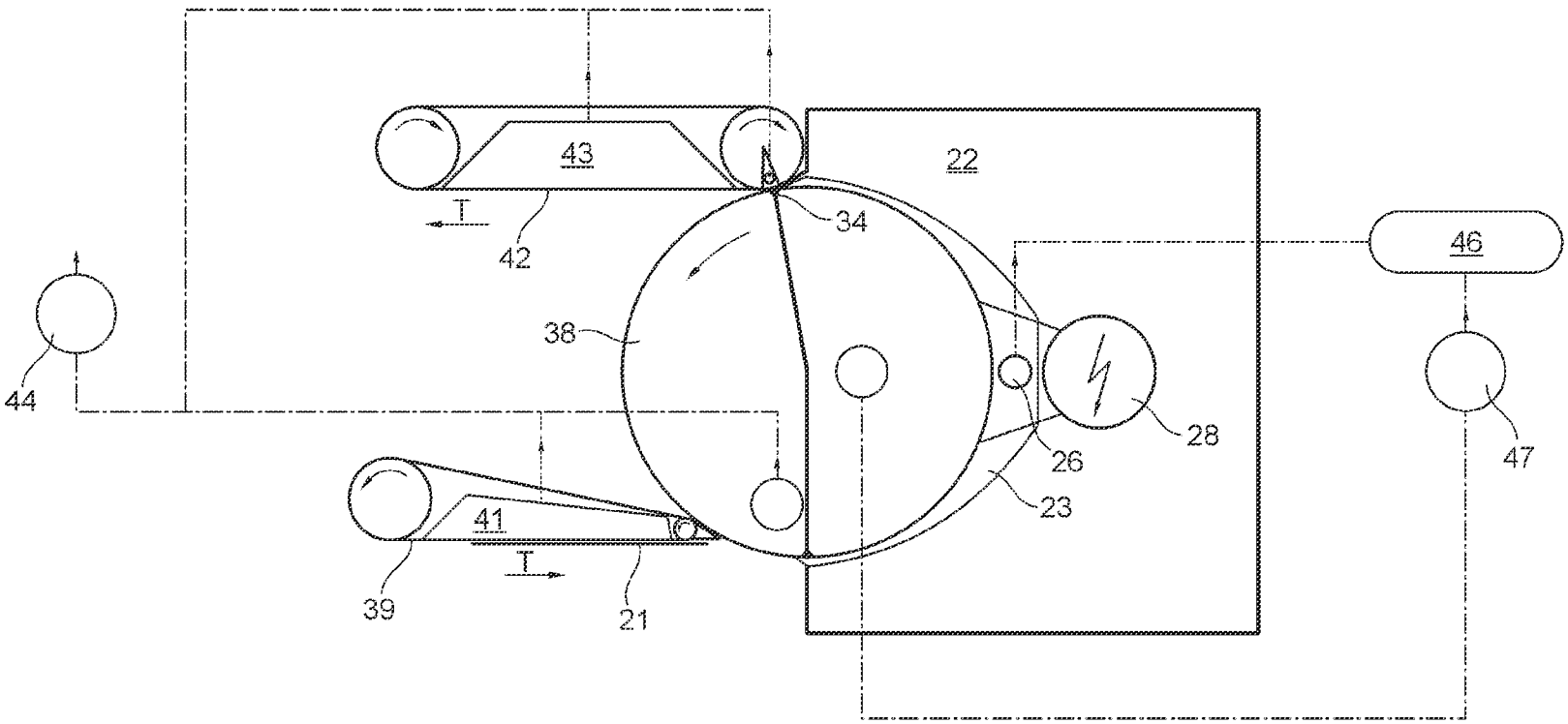
Figure 8:
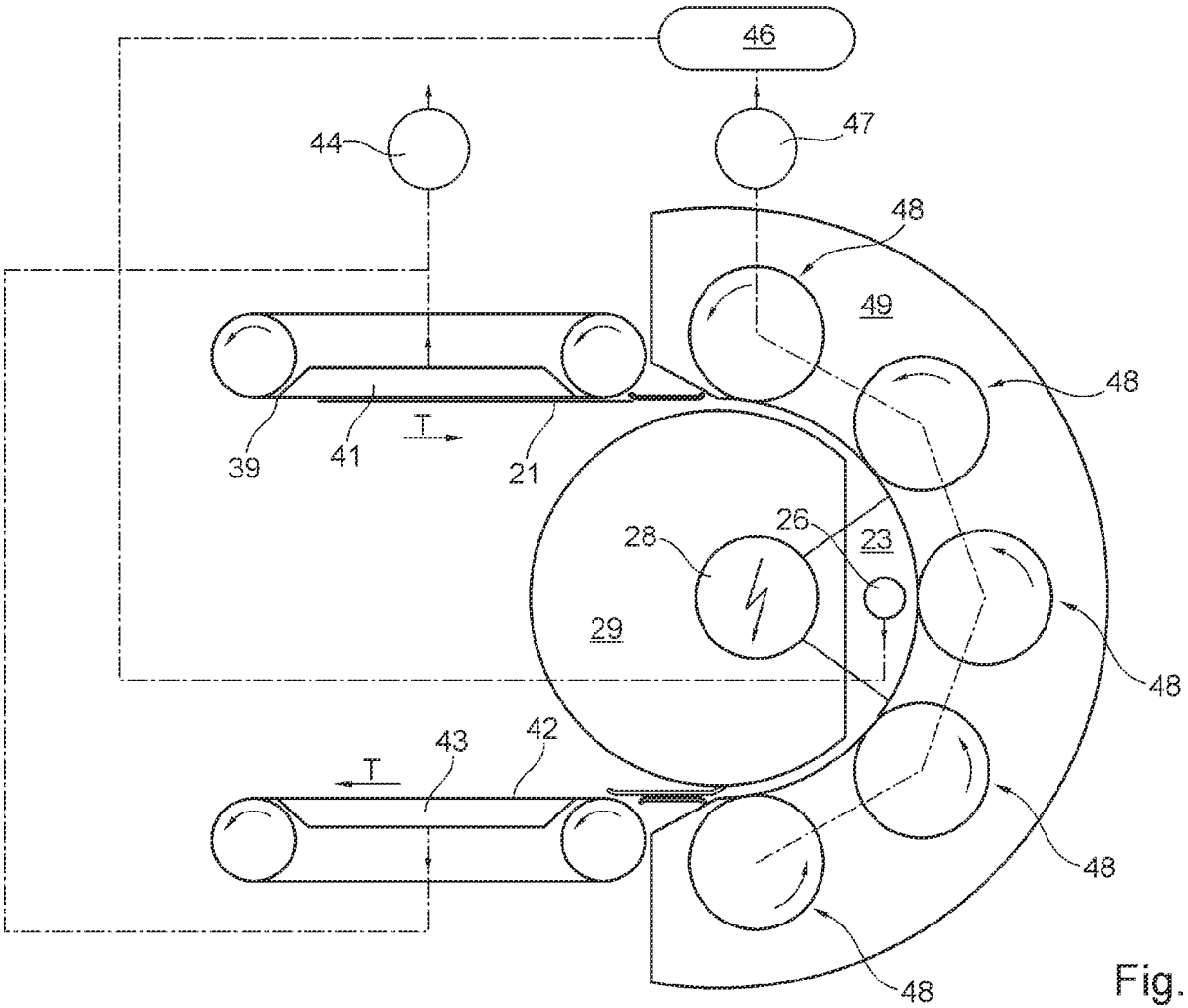
Figure 9:
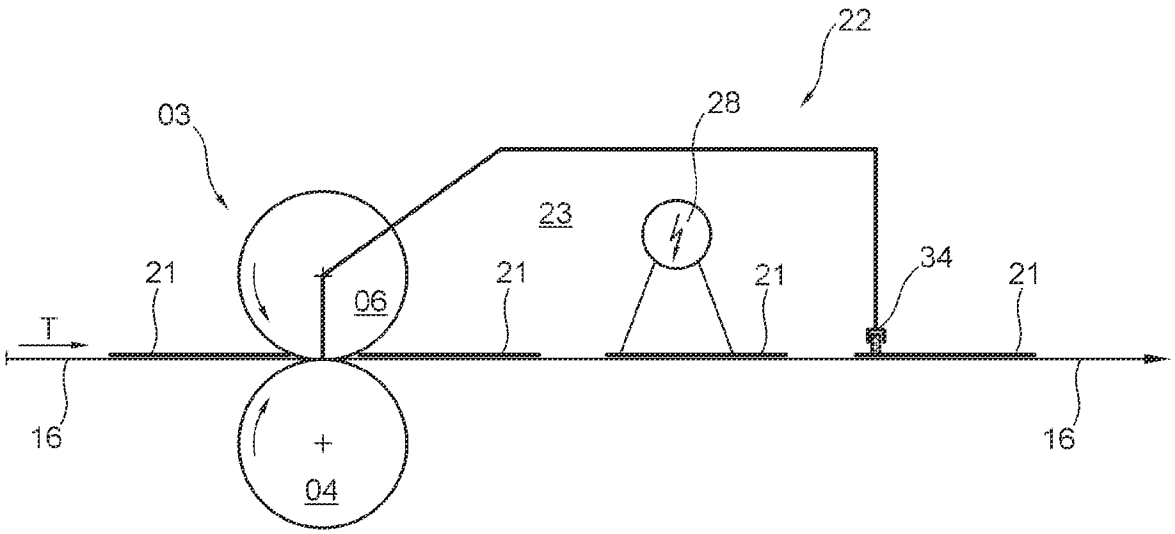

Here are shown:

FIG. 1 a printing machine having at least one printing mechanism;

FIG. 2 a drying unit for electron radiation curing;

FIG. 3 a cut-out of the printing machine depicted in FIG. 1 having a first arrangement of a drying unit for electron radiation curing in the printing mechanism;

FIG. 4 a cut-out of the printing machine depicted in FIG. 1 having a second arrangement of a drying unit for electron radiation curing in the printing mechanism;

FIG. 5 a cut-out of the printing machine depicted in FIG. 1 having an arrangement of a drying unit for electron radiation curing on an intermediary cylinder;

FIG. 6 a cut-out of a printing machine having an arrangement of a drying unit for electron radiation curing on a transportation device;

FIG. 7 a drying unit activated on a suction cylinder for electron radiation curing;

FIG. 8 a drying unit for electron radiation curing in connection with several suction rollers;

FIG. 9 a drying unit that can be used as an independent component.

By way of example, FIG. 1 shows a printing machine, preferably a rotation printing machine, respectively having at least one printing mechanism. The printing machine is formed e.g. as a sheet printing machine, preferably as a sheet rotation printing machine, in particular as a sheet gravure printing machine, especially particularly as a sheet rotation printing machine printing in an intaglio printing method. The intaglio printing method is a gravure printing method that is preferably used for the industrial production of banknotes, security documents or security elements.

The sheet rotation printing machine printing in an intaglio printing method, in particular, depicted by way of example in FIG. 1 preferably has at least the following machine units or assemblies:

a) a sheet feeder 01, by means of which a substrate 21 to be printed is provided or at least can be provided in the form of in particular stacked printing sheets 21 on the sheet rotation printing machine; the rectangular printing sheets 21 have e.g. an edge measurement in the range of between 475×450 mm and 700×820 mm; the grammage of the printing sheets ranges, for example, from 70 g/m$^2$ to 120 g/m$^2$;

b) a sheet feed 02, by means of which printing sheets 21 provided on the sheet feeder 01, are supplied or at least can be supplied to a printing mechanism 03 of the sheet rotation printing machine in a sequence, i.e. individually one after the other, e.g. via one or more transfer drums;

c) at least one printing mechanism 03, having a printing cylinder 04, also referred to as the counter printing cylinder, and a plate cylinder 06 interacting with the printing cylinder 04 and applying a printed image to the relevant printing sheets 21, wherein the printing cylinder 04 and the plate cylinder 06 are activated or at least can be set against each other at high pressure; a wiping cylinder 07 is activated or at least can be set against the plate cylinder 06; the printing cylinder 04 and plate cylinder 06 are preferably produced from steel; the wiping cylinder 07 is coated e.g. with a plastic on its outer surface; in the preferred embodiment, the printing cylinder 04 and the plate cylinder 06 are each divided into several, in particular into three, respectively equally large segments, in each case on their periphery, wherein in each case a printing cloth is arranged or at least can be arranged respectively e.g. on an underlay in each of the segments arranged one behind the other on the printing cylinder 04;

d) a collection cylinder 08 activated or at least that can be activated on the plate cylinder 06, also referred to as an Orlof-type cylinder 08; the Orlof-type cylinder 08, much like the printing cylinder 04 and plate cylinder 06, has three equally large segments on its periphery;

e) an ink train unit 09, having several, e.g. five or six, template cylinders 11 that are activated or at least can be activated on the Orlof-type cylinder 08, on the periphery of which in each case one template plate is arranged or at least can be arranged; here, each of the template cylinders 11 dyes the Orlof-cylinder 08 preferably in each case with a different printing ink, wherein the Orlof-type cylinder 08 collects the respective printing ink from all activated template cylinders 11 during one single rotation; one or more colour application rollers 12 are activated or at least can be activated on each template cylinder 11, wherein the colour application rollers 12 are each dyed by a printing ink from an ink reservoir 14, e.g. from an ink duct roller 13 removed from the ink box; the type of construction described here of the printing machine accordingly makes a multicoloured printing of the printing sheets 21 possible at a single printing position; alternatively or in addition to the ink train unit 09, a lacquer mechanism can also be provided for applying a lacquer to the respective printing sheets 21;

f) a transportation device 16 formed e.g. as a peripheral transport strip or as a peripheral chain system, in particular chain grip system, to which printing sheets 21 printed in a printing gap 17 between the printing cylinder 04 and the plate cylinder 06 are passed over directly or via at least one intermediary cylinder 36; 37, wherein printing sheets 21 passed over to the transportation device 16 are transported or at least can be transported by means of this to a delivery 18, here a sheet delivery 18, formed e.g. as a multiple stack delivery, and are or at least can be deposited there; in FIG. 1, the sheet delivery 18 has e.g. three stacks arranged one behind the other in the transport direction T of the printing sheets 21; generally, an e.g. optoelectronic, preferably camera-based, inspection system 19 is arranged in the region of the transportation device 16, by means of which inspection system the quality of the printed printing sheets 21 is checked or at least can be checked; the printing sheets are checked, in particular, for their absence of errors in comparison to a predetermined template; depending on the result of this check, the printing sheets 21 are then deposited on a specific stack of the multiple stack delivery.

In order to achieve as high a printing speed as possible of e.g. 10,000 printing sheets 21 per hour using the printing machine described above by way of example in an industrial production process, the printing inks applied to the printing sheets 21 and/or the lacquer applied to the printing sheets 21 are preferably dried. Preferably, printing inks and/or lacquers that do not run, i.e. are viscous, are used. In the preferred embodiment, printing inks and/or lacquers that are radiation-cured are used. In a particularly preferred embodiment, printing inks and/or lacquers that do not include solvents and that can be cured by an electron beam are used. Such printing inks and/or lacquers polymerise with radiation by an electron beam within milliseconds and are thus dried in an extremely short period of time. A coloured film or lacquer film consisting of such printed inks and/or lacquers is polymerised completely and is thus also cured completely, such that, after drying, no fragments or residues of the split remain in the printing inks or lacquers, which could migrate somewhere else using the substrate 21. Printing inks or lacquers dried by an electron beam form an elastic, glossy coloured film or lacquer film which, in each case, is highly resistant to scratches and chemicals.

However, it is problematic in a drying method using an electron beam that the drying, i.e. the setting reaction, has to take place in an oxygen-reduced inert atmosphere, in which the amount of oxygen is at most 1% in order to obtain high production quality, preferably ranging from 300 ppm to 500 ppm, in particular ranging from 150 ppm to 250 ppm, where necessary even lower into the region of less than 50 ppm, wherein the amount of oxygen permissible in the inert atmosphere is dependent on the material of the substrate used and/or on the chemical composition of the printing ink(s) or lacquers used. In other circumstances, i.e. with a higher amount of oxygen, free radicals contained in the printing inks or lacquers that are still liquid, i.e. atoms or groups of atoms which each contain a free electron, would chemically react more quickly with the oxygen molecules contained in this air than among one another and would form only one incomplete, irregular cross-linkage. In normal ambient air, this is particularly true with an oxygen amount of about 21%. In an atmosphere with an oxygen amount of more than 1%, in particular in normal ambient air, the setting reaction leads to the printing inks or the lacquer still being damp, adhesive and without shine and having poor adhesion properties and only a low scratch resistance.

Good drying results are obtained in a drying unit 22 with an atmosphere reduced to an oxygen amount of at most 1%, in which an inert gas, i.e. a gas that is chemically very sluggish, i.e. an elementary gas such as nitrogen or a noble gas such as helium, neon, argon, krypton, xenon or radon or a gaseous molecular compound such as sulphur hexafluoride and carbon dioxide, suppresses the oxygen contained in the air. Oxidative processes are prevented by an inert gas as a result of the suppression or clear reduction of oxygen. Here and below—insofar as reference is made to the spatial content of the drying unit 22—the term "atmosphere" is referred to in its entirety as the gaseous medium that is oxygen-reduced by the inert gas, which is present in the drying unit 22 in a chamber provided for drying the printing inks or the lacquer.

FIG. 2 illustrates the operating principle of the radiation drying with an electron beam. Even though the examples described below primarily relate to a drying of printed inks, they also correspondingly apply to the drying of lacquers. A drying unit 22 that can be used in connection with a printing machine, in particular with the printing machine described by way of example, has a chamber 23 passed through by the substrate 21, e.g. the printing sheets 21, filled with an inert gas or containing at least one inert gas, wherein e.g. a doctor blade nozzle 24, in particular in the form of a nozzle beam, is arranged at the entrance of the chamber 23, at which the printing sheets 21 are guided into the chamber 23 containing the inert gas, in order to prevent the inert gas leaking out of the chamber 23 at this entrance and/or oxygen from the ambient air entering this chamber 23. Because of the flatness of the printing sheets 21, the entrance of the chamber 23 is generally formed as a narrow slot extending transversely to the transport direction T of the printing sheets 21 across its entire width. In order to fill the chamber 23 with the inert gas, e.g. with nitrogen, and/or in order to maintain the desired filling level, a filling nozzle 26 letting inert gas into the chamber 23 as needed, in particular remote-controllable, is provided, wherein this filling nozzle 26 is attached to an inert gas source, e.g. to a tank. Furthermore, a sensor 27 is preferably provided for measuring the amount of oxygen in the chamber 23 containing the inert gas. The filling nozzle 26 is preferably controlled, or at least can be controlled, depending on a measured result of the sensor 27 in order to measure the amount of oxygen in the chamber 23 containing the inert gas in relation to the inlet of inert gas into the chamber 23. Accordingly, when a filling nozzle 26 connected to the inert gas source, in particular remote-controllable, and a sensor 27 are respectively provided to measure the amount of oxygen present in this chamber 23, then the amount of oxygen in the inert atmosphere prevalent in this chamber 23 is preferably set or at least can be set e.g. by a control unit, in particular automatically depending on a measured result of the sensor 27 for measuring the amount of oxygen and/or depending on the material of the printing sheets 21 to be dried and/or depending on the chemical composition of at least one printing ink applied to the printing sheets 21 or a lacquer.

The drying unit 22 has an electron beam generator 28 which is arranged in a vacuum chamber 29. The vacuum chamber 29 and the chamber 23 filled with the inert gas are spatially separated from one another by a window. The window has a seal 31, e.g. made of a titanium film with a material strength ranging from e.g. 0.01 mm to 0.3 mm, preferably at about 0.2 mm. The electron beam generator 28 has a cathode 32, e.g. in the form of a filament, and an anode 33 spaced apart from the cathode 32. Electrons emerging from the cathode 32 are accelerated by an electrical voltage placed between the cathode 32 and the anode 33 in the direction of the anode 33 virtually at the speed of light. The electrical voltage for accelerating the electrons lies in this region e.g. between 80 keV and 300 keV depending on a state, e.g. chemical composition, of the printing inks used and/or the desired penetration depth into these printing inks and/or on the material of the substrate 21 used. The energised electrons accelerated in this way penetrate the seal 31, consisting e.g. of a thin titanium film, of the window and hit preferably substantially perpendicularly on the printing sheets 21 guided past at this window in the chamber 23 containing inert gas. The energised electrons are quasi enclosed into the printed inks applied to the substrate 21. When these electrons impact on the printing inks applied to the substrate 21 with a layer thickness of e.g. about 0.1 mm and when the electrons penetrate into this colour layer, a chemical chain reaction is triggered in this printing method, in which short-chain acrylate molecules contained in the printing ink are connected to form long-chain polymers, whereby a cured coloured layer is formed in second fractional parts. The substrate 21 is not heated up. Because the energy of the electrons fired at the substrate 21 by the electron beam generator 28 is great enough to generate the first radicals in the printed inks and to initiate the polymerisation directly in the monomers (diluents) or oligomers (binding agents) of these printing inks, it is not necessary to add photo-initiators to the printing inks used, as would have been necessary e.g. for a UV drying process.

Oligomers used in printing inks suitable for gravure printing methods include, e.g. epoxy acylates, acrylated oils, urethane acrylates, polyester acrylates, silicone acrylates, acrylated amines, acryl-saturated resins and acryl acrylates.

Because of the high viscosity of most oligomers, diluents are required to reduce the overall viscosity of a printing ink cured by an electron beam and thus to support the handling and application of these printing inks, e.g. to make these printing inks suitable for wiping on the plate cylinder 06 by the wiping cylinder 07. Suitable diluents can include water or "reactive" monomers, which are incorporated in the relevant printing ink. Reactive monomers are typically acrylates and methacrylates and can be monofunctional or multifunctional. For example, multifunctional monomers would be polyester acrylates or polyester methacrylates, polyol acrylates or polyomethacrylates and polyether acrylates or polyether methacrylates.

Some examples for the respective composition of layers made of printing inks or lacquers which can be respectively dried by an electron beam follow:

EXAMPLE 1

| Product name | Manufacturer | chemical name / more detailed specification | Amount/ Wt.-% |
|---|---|---|---|
| Ebecryl ™ 83 (Eb 83) | Cytec Surface Specialities | Polyether acrylate oligomer | 60 |
| TPGDA | Rahn or Sartomer | Tri(propylene glycol) diacrylate | 35 |
| Darocur ® 1173 | Ciba Specialty Chemicals | 2-hydroxy-2-methyl-1-phenyl-propane-1-one | 5 |

EXAMPLE 2

| Product name | Manufacturer | chemical name/ more detailed specification | Amount/ Wt.-% |
|---|---|---|---|
| Ebecryl ™ 270 (Eb 270) | Cytec Surface Specialities | Urethane acrylate oligomer (aliphatic) | 25 |
| Ebecryl ™ 265 (Eb 265) | Cytec Surface Specialities | Urethane acrylate oligomer (aliphatic, trifunctional) | 30 |
| Genomer 1122 | Rahn | Urethane acrylate (monofunctional) | 40 |
| Darocur ® 1173 | Ciba Specialty Chemicals | 2-hydroxy-2-methyl-1-phenyl-propane-1-one | 5 |

EXAMPLE 3

| Product name | Manufacturer | chemical name / more detailed specification | Amount/ Wt.-% |
|---|---|---|---|
| Ebecryl ™ 130 (Eb 130) | Cytec Surface Specialities | Tricyclodecane dimethanol diacrylate | 25.0 |
| Sartomer 238 (HDDA) | Sartomer | 1,6-hexanediol diacrylate | 10.0 |
| Miramer 600 (DPHA) | Rahn | Dipentaerythritol hexaacrylate | 5.0 |
| Ebecryl ™ 220 (Eb 220) | Cytec Surface Specialities | Urethane acrylate oligomer (aromatic, hexafunctional) | 40.0 |

-continued

| Product name | Manufacturer | chemical name / more detailed specification | Amount/ Wt.-% |
|---|---|---|---|
| Ebecryl ™ 83 (Eb 83) | Cytec Surface Specialities | Polyether acrylate oligomer (multifunctional) | 11.8 |
| Darocur ® 1173 | Ciba Specialty Chemicals | 2-hydroxy-2-methyl-1-phenyl-propane-1-one | 8.0 |
| Irgcure ™ 369 (IR 369) | Ciba Specialty Chemicals | 2-benzy1-2-dimethylamino-1-(4-morpholinophenyl)-butanone | 0.2 |

EXAMPLE 4

| Product name | Manufacturer | chemical name / more detailed specification | Amount/ Wt.-% |
|---|---|---|---|
| Cyracure ™ UVR-6110 | Dow Chemical Company | Epoxy resin (cycloaliphatic) | 77.0 |
| Castor Oil | Gustav Heess Oleochemische Erzeugnisse GmbH | Castor oil | 11.0 |
| n-Propanol | OXEA Deutschland | n-propanol | 5.0 |
| UVI-6992 | Dow Chemical Company | Mixture of triarylsulphonium hexafluorophosphate salts and propylene carbonate | 7.0 |

EXAMPLE 5

| Product name | Manufacturer | chemical name / more detailed specification | Amount/ Wt.-% |
|---|---|---|---|
| Cyracure ™ UVR-6110 | Dow Chemical Company | Epoxy resin (cycloaliphatic) | 81.0 |
| UVI-6992 | Dow Chemical Company | Mixture of triarylsulphonium hexafluorophosphate salts and propylene carbonate | 9.0 |
| DVE-3 | BASF Corporation | triethylene glycol divinyl ether | 10.0 |

EXAMPLE 6

| Product name | Manufacturer | chemical name / more detailed specification | Amount/ Wt.-% |
|---|---|---|---|
| Cyracure ™ UVR-6128 | Dow Chemical Company | Epoxy resin (cycloaliphatic) | 69.0 |
| UVI-6992 | Dow Chemical Company | Mixture of triarylsulphonium hexafluorophosphate salts and propylene carbonate | 4.0 |
| TONE ™ 0305 | Dow Chemical Company | Polyol (trifunctional) | 27.0 |

EXAMPLE 7

| Product name | Manufacturer | chemical name / moredetailed specification | Amount/ Wt.-% |
|---|---|---|---|
| Cyracure ™ UVR-6110 | Dow Chemical Company | Epoxy resin (cycloaliphatic) | 60.0 |

-continued

| Product name | Manufacturer | chemical name / moredetailed specification | Amount/ Wt.-% |
|---|---|---|---|
| TMPO ® | Perstorp Specialty Chemicals AB | Trimethylol propanoxetane | 20.0 |
| Boltorn H2004 | Perstorp Specialty Chemicals AB | dendritic polymer with high hydroxyl functionality | 16.0 |
| Irgacure ® 250 | Ciba Specialty Chemicals | Idonium, (4-methylphenyl) [4-(2-methylpropyl)phenyl]-, hexafluorophosphate | 3.5 |
| Genocure ™ ITX | Rahn | Isopropyl thioxanthone | 0.5 |

Now, to carry out a radiation drying of printed inks or lacquers applied to the substrate 21, in each case with an electron beam in a printing machine for the industrial production of banknotes, security documents or security elements, some arrangement variants are now described below. In all these arrangement variants, the drying unit 22 has an electron beam generator 28 by means of which energised electrons are fired at the substrate 21.

A first arrangement variant provides to arrange the entire printing machine in an enclosure sealed with respect to the ambient air, wherein an inert atmosphere is provided with an oxygen amount of at most 1% inside the enclosure. The chamber 23, containing the inert gas, of the drying unit 22 is implemented here by the enclosure of the printing machine. The printing sheets 21 to be printed are supplied to the printing machine by an entrance floodgate formed on the enclosure and are discharged from the printing machine through an exit floodgate formed on the enclosure. In this first arrangement variant, the drying unit 22 is arranged at any position in the transport direction T of the substrates 21 formed, in particular, in each case as printing sheets 21, behind the printing gap 17 formed by the printing cylinder 04 and plate cylinder 06, e.g. also on or in the transport direction T of the printing sheets 21 after the transportation device 16, which is arranged after the printing mechanism 03 in the transport direction T of the printed sheets 21 and is formed e.g. as a peripheral transport strip or as a peripheral chain system or as a chain gripper system.

A second arrangement variant provides to arrange the drying unit 22 in the printing mechanism 03 of the printing machine. The chamber 23, containing the inert gas, of the drying unit 22 is here arranged in the printing mechanism 03 in such a way that at least one arc section of the printing cylinder 04 is arranged inside this chamber 23.

FIG. 3 shows a cut-out of the printing machine depicted in FIG. 1, wherein an arc section of the printing cylinder 04 and the arc section of the plate cylinder 06 interacting with this printing cylinder 04 are arranged inside the chamber 23 containing the inert gas. Here, a preferably flexible seal 34 arranged on the chamber 23 containing the inert gas, said seal respectively sealing this chamber 23 with respect to the ambient air on the respective end faces of the printing cylinder 04 and plate cylinder 06 and on the outer surface of the plate cylinder 06 and, where necessary, on the printing gap 17 formed by the printing cylinder 04 and plate cylinder 06 and at an exit from the chamber 23 on the dried substrates 21 resting on the outer surface of the rotating printing cylinder 04. Here, it is remarkable that the printing cylinder 04 and the plate cylinder 06 are set against each other in the printing gap 17 formed by them in a printing process implemented by the relevant printing machine under high pressure, and the cylinders 04; 06 set against each other already form a seal running axially to these cylinders 04; 06 for the chamber 23 containing the inert gas in the printing gap formed by them. Substrates 21 dried by means of the drying unit 22, in particular printing sheets 21, are passed over from the printing cylinder 04 to a transportation device 16 following on from the printing cylinder 04 in the transport direction T of the printing sheets 21.

FIG. 4 also shows a cut-out of the printing machine depicted in FIG. 1, wherein only one arc section of the printing cylinder 04 is arranged inside the chamber 23 containing the inert gas. A preferably flexible seal 34 is arranged on the chamber 23 containing the inert gas, said seal respectively sealing this chamber 23 with respect to the ambient air on the end faces of the printing cylinder 04 and at an exit from the chamber 23 on the dried substrates 21 resting on its outer surface. At the entrance of the chamber 23, a narrow slot extending transversely to the transport direction T of the substrate 21 over its entire width is formed, through which slot a substrate 21 resting on the outer surface of the printing cylinder 04 is guided or at least can be guided into the chamber 23 of the dying unit 22, wherein a doctor blade nozzle 24, in particular in the form of a nozzle beam, is arranged longitudinally in relation to this slot, in order to prevent the inert gas leaking out of the chamber 23 at this entrance and/or oxygen from the ambient air entering this chamber 23. In this embodiment too, substrates 21 dried by means of the drying unit 22, in particular printing sheets 21, are passed over from the printing cylinder 04 to a transportation device 16 following on from the printing cylinder 04 in the transport direction T of the printing sheets 21.

FIG. 5 also shows a cut-out of the printing machine depicted in FIG. 1, wherein, in contrast to the embodiment depicted in FIG. 1, printing sheets 21 printed in the printing gap 17 between the printing cylinder 04 and the plate cylinder 06 are passed over to the transportation device 16 via two intermediary cylinders 36; 37 arranged one after the other in the transport direction T of the printing sheets 21. In a third arrangement variant, it is provided that the drying unit 22 is arranged on one of the intermediary cylinders 36; 37. In turn, a preferably flexible seal 34 is arranged on the chamber 23 containing the inert gas, said seal respectively sealing this chamber 23 with respect to the ambient air at the end faces of the relevant intermediary cylinder 36; 37 and at an exit from the chamber 23 on the drying substrate 21 resting on the outer surface of the relevant intermediary cylinder 36; 37. A narrow slot extending transversely to the transport direction T of the substrate 21 across its entire width is formed at the entrance of the chamber 23, through which slot a substrate 21 resting on the outer surface of the relevant intermediary cylinder 36; 37 is introduced or at least can be introduced into the chamber 23 of the drying unit 22, wherein a doctor blade nozzle 24, in particular in the form of a nozzle beam, is arranged longitudinally in relation to this slot in order to prevent the inert gas leaking from the chamber 23 at this entrance and/or oxygen from the ambient air entering this chamber 23.

As depicted by way of example in FIG. 6, it is provided as a fourth arrangement variant that the drying unit 22 is arranged on or at least in connection with the transportation device 16 formed e.g. as a transport strip. In turn, a preferably flexible seal 34 is arranged on the chamber 23 containing the inert gas, said seal sealing this chamber 23 with respect to the ambient air at the exit from the chamber 23 on the drying substrate 21 transported by the transportation device 16. A narrow slot extending transversely to the transport direction T of the substrate 21 across its entire width is formed at the entrance of the chamber 23, through which slot a substrate 21 transported by the transportation device 16 is introduced or at least can be introduced into the chamber 23 of the drying unit 22, wherein a doctor blade nozzle 24, in particular in the form of a nozzle beam, is arranged longitudinally to this slot in order to prevent the inert gas leaking out of the chamber 23 at this entrance and/or oxygen from the ambient air entering this chamber 23.

As illustrated by means of the second to fourth arrangement variants, the drying unit 22 having a chamber 23 containing the inert gas can be arranged, for example, in the printing mechanism 03 of the printing machine or on an intermediary cylinder 36; 37 arranged after the printing mechanism 03 in the transport direction T of the substrates 21 or on the transportation device 16 transporting the substrates 21 to a delivery 18.

By way of example, FIGS. 7 and 8 schematically show various designs of the drying unit 22 for electron beam curing. Thus, FIG. 7 shows a drying unit 22 activated on a suction cylinder 38 for electron beam curing, wherein the suction cylinder 38 can be a particular design e.g. of the printing cylinder 04 or an intermediary cylinder 36; 37, and has at least one arc section found within the chamber 23 of the drying unit 22. A first transportation device, e.g. in the form of a transport strip, in particular a suction strip 39 preferably having a suction box 41, or a cylinder or a roller, directly superordinate to the suction cylinder 38 in the transport direction T of the substrates 21, supplies printed substrates 21 sequentially to the suction cylinder 38, wherein the suction cylinder 38 can receive several, e.g. three, substrates 21 formed, in particular, as printing sheets 21, one after the other on its outer surface. Substrates 21 supplied to the suction cylinder 38 are held on its outer surface by suction air. With a continuous rotation of the suction cylinder 38, the printed substrates 21 are guided through a narrow slot extending transversely to the transport direction T of the substrates 21 across their entire width into the chamber 23, containing the inert gas, of the drying unit 22. The electron beam generator 28, which dries the printed substrates 21 in the manner described above by firing with energised electrons, is in the drying unit 22. The drying substrates 21 resting on the outer surface of the rotating suction cylinder 38 leave the drying unit 22 at the exit of the chamber 23, wherein the exit of the chamber 23 is formed as a narrow slot extending transversely to the transport direction T of the substrates 21 across its entire width and is preferably sealed by a particularly flexible seal 34. In the rotational direction of the suction cylinder 38 and thus in the transport direction T of the substrates 21, a second transportation device, e.g. in turn in the form of a transport strip, in particular a suction strip 42 preferably having a suction box 43, or a cylinder or a roller, is arranged directly behind the exit from the chamber 23, said transportation device transporting the dried substrates 21 e.g. to a delivery 18.

As can be seen in FIG. 7, in this embodiment variant, two pneumatic systems separated from each other are provided. The first pneumatic system provides the respectively required suction air for holding the substrates 21 to be transported by means of a pump 44 and generally via corresponding lines, e.g. on the suction cylinder 38 and/or on the suction box 41 of the suction strip 39 of the first transportation device and/or on the suction box 43 of the suction strip 42 of the second transportation device. The second pneumatic system has an inert gas source, e.g. in the form of a tank 46, for providing the inert gas required by the drying unit 22, wherein the filling nozzle 26 arranged on the chamber 23 of the drying unit 22 and letting inert gas into the chamber 23 is preferably connected to this tank 46. Furthermore, the second pneumatic system has a pump 47 connected on the entrance side e.g. to the suction cylinder 38 and on the exit side to the tank 46, in order to hold a substrate 21, which is arranged on the arc section of the suction cylinder 38 found inside the chamber 23 of the drying unit 22, on the outer surface of this suction cylinder 38 by suction. In this respect, the second pneumatic system also generates suction air, wherein this suction air used in the second pneumatic system usually has an inert atmosphere that is clearly oxygen-reduced in comparison to the ambient air usually used by the first pneumatic system with an oxygen amount of preferably at most 1%. It is advantageously provided that the first pneumatic system and the second pneumatic system are formed to be separate from each other, wherein the first pneumatic system provides the necessary suction air for holding the substrates 21 to be transported on the suction cylinder 38 when a substrate 21 held on the outer surface of the suction cylinder 38 can be found outside the chamber 23 of the drying unit 22, and the second pneumatic system then at least provides the required suction air for holding the substrates 21 to be transported when the substrate 21 held on the outer surface of the suction cylinder 38 can be found inside the chamber 23 of the drying unit 22.

In a further design variant, it is provided that e.g. only one single pneumatic system is provided, wherein the same gaseous medium as in the chamber 23 of the drying unit 22 is provided for the required suction air for holding the substrates 21 to be transported on the outer surface of the suction cylinder 38, in particular during their entire dwelling time on the relevant suction cylinder 28. Thus, e.g. a rotation printing machine having at least one printing mechanism 03 for printing substrates 21 emerges, wherein the relevant printing mechanism 03 has at least two interacting cylinders 04; 06, wherein at least one of these cylinders 04; 06 is formed as a suction cylinder transporting the substrates 21 on its outer surface, wherein a pneumatic system for providing the required suction air for holding the substrates 21 to be transported on the outer surface of the relevant cylinder 04, 06 is provided. Here, in or after the relevant printing mechanism 03, a drying unit 22 is provided in the transport path of the substrates 21, wherein substrates 21 printed by the relevant printing mechanism 03 are guided or at least can be guided through a chamber 23 of this drying unit 22, wherein a gaseous medium that is oxygen-reduced by an inert gas is provided in the chamber 23 of the drying unit 22. Here, in an advantageous design, the suction air provided in the pneumatic system for holding the substrates 21 to be transported on the outer surface of the relevant suction cylinder is the same gaseous medium as in the chamber 23 of the drying unit 22. Preferably, one of the cylinders 04 interacting in the relevant printing mechanism 03 is formed as a printing cylinder 04 and the other cylinder 06 interacting with the printing cylinder 04 is formed as a plate cylinder 06 applying a printed image to the relevant substrates 21. In the very preferable design, the relevant printing mechanism 03 is formed as a printing mechanism 03 printing in a deep-draw printing process, in particular in a gravure printing process.

FIG. 8 shows a design of the drying unit 22 for electron beam curing, in which several suction rollers 48 are provided along the transportation path of the substrates 21 for the transportation of the substrates 21 through the chamber 23 of the drying unit 22 in a housing 49 partially, e.g. semi-circularly, surrounding the vacuum chamber 29 having the electron beam generator 28, wherein these suction rollers 48 convey substrates 21 introduced into the chamber 23 of the drying unit 22 as a result of their respective rotation from an entrance of the chamber 23 to its exit. The electron beam generator 28 is fixedly arranged e.g. in or near the centre of the drying unit 22 and has an electron beam directed radially outwards, wherein substrates 21 to be dried are guided or are being guided around the vacuum chamber 29 having the electron beam generator 28 respectively with their printed side facing towards the electron beam generator 28 along its transportation path at least partially, e.g. in a semicircle in a sheet. The suction rollers 48 arranged along the transportation path of the substrates 21 are respectively arranged on the side that is not to be dried of the substrates 21 to be conveyed through the chamber 23 of the drying unit 22. The entrance of the chamber 23 and its exit are preferably each formed as a narrow slot extending transversely to the transport direction T of the substrates 21 across their entire width. A first transportation device arranged directly in front of the entrance of the chamber 23 in the transport direction T of the substrates 21 is formed e.g. in the form of a transport strip, in particular a suction strip 39 preferably having a suction box 41, or a cylinder or a roller and sequentially supplies printed substrates 21 to the chamber 23 of the drying unit 22. A second transportation device, e.g. in turn in the form of a transport strip, in particular a suction strip 42 preferably having a suction box 43, or a cylinder or a roller is arranged directly behind the exit from the chamber 23 in the transport direction T of the substrates 21, which transportation device transports the dried substrates 21 to a delivery 18.

In the design variant according to FIG. 8, e.g. two pneumatic systems separated from each other are again provided. The first pneumatic system provides the respectively required suction air for holding the substrates 21 to be transported by means of a pump 44 and via corresponding lines, e.g. on the suction box 41 of the suction strip 39 of the first transportation device and/or in the suction box 43 of the suction strip 42 of the second transportation device. The second pneumatic system has an inert gas source, e.g. in the form of a tank 46, for providing the inert gas required by the drying unit 22, wherein the filling nozzle 26 arranged on the chamber 23 of the drying unit 22 and letting inert gas into the chamber 23 is connected to this tank 46. Furthermore, the second pneumatic system has e.g. a pump 47 connected on the entrance side to the suction rollers 48 and on the exit side to the tank 47, wherein a substrate 21, which is conveyed by the suction rollers 48 on the transportation path found inside the chamber 23 of the drying unit 22, is held on the transportation path provided by means of a suction effect caused by the pump 47.

Since the provision of an inert gas, e.g. nitrogen, in a drying unit 22 involved in an industrial production process for electron beam curing is associated with considerable costs, the entrance provided for the substrates 21 into the chamber 23 of the drying unit 22 and/or the exit from this chamber 23 are each formed e.g. in the shape of slots and/or are each e.g. sealed by a doctor blade nozzle 24, in particular in the form of a nozzle beam or by a preferably flexible seal 34.

A further measure for minimising a leakage of the oxygen-reduced gaseous medium, in particular of inert gas, from the chamber 23 and/or an unwanted entering of oxygen from the ambient air into this chamber 23 is respectively covering, with a cover, channels 51 or grooves 51, which are formed on a cylinder at least partially, e.g. in a sheet section, passing through the chamber 23 of the drying unit 22, e.g. on a printing cylinder 04 or on a plate cylinder 06 or on an intermediary cylinder 36; 37 or on a suction cylinder 38. If at least one gripper for holding a substrate 21 on the respective outer surface of the relevant cylinder is arranged in such a channel 51 extending in particular transversely to the transport direction T of the substrate 21 across the width, the cover covering this channel 51 has a recess at the position of the relevant gripper. However, in terms of the leak-tightness of the chamber 23 of the drying unit 22, it is advantageous to form the relevant cylinder 04; 06; 36; 37; 38 respectively without a gripper, i.e. without a mechanical gripper, or, in the case of interacting cylinders 04; 06 such as the printing cylinder 04 and the plate cylinder 06, to form at least one of these cylinders 04; 06 without a gripper. Substrates 21 to be arranged on their respective outer surface are preferably held on cylinders 04; 06; 36; 37; 38 formed without grippers in each case only by suction air. Similarly, it is also advantageous to form a transportation device 16 formed as a transport strip without a gripper for transporting substrates 21.

Thus, e.g. a rotation printing machine having at least one printing mechanism 03 for printing substrates 21 emerges, wherein a drying unit 22 is provided in or after the at least one printing mechanism 03 in the transportation path of the substrates 21, wherein substrates 21 printed by the at least one printing mechanism 03 are guided or at least can be guided through a chamber 23 of this drying unit 22, wherein an atmosphere that is oxygen-reduced by an inert gas is provided in the chamber 23 of the drying unit 22, wherein the chamber 23 of the drying unit 22 surrounds at least one arc section of a cylinder 04; 06; 36; 37; 38 transporting the substrate 21 to be dried, wherein this cylinder 04; 06; 36; 37; 38 has at least one gripper for holding one of the substrates 21 on the outer surface of the relevant cylinder 04; 06; 36; 37; 38 in a channel 51 extending transversely to the transport direction T of the substrates 21, wherein the relevant channel 51 is covered by a cover, where in the cover has a recess at the position of the relevant gripper, wherein the relevant cylinder 04; 06; 36; 37; 38 has at least one further holding element for holding the relevant substrate 21 on the outer surface of the relevant cylinder 04; 06; 36; 37; 38 on its outer surface in addition to the at least one gripper.

Alternatively, e.g. a rotation printing machine having at least one printing mechanism 03 for printing substrates 21 emerges, wherein a drying unit 22 is provided in or after the at least one printing mechanism 03 in the transport path of the substrates 21, wherein substrates 21 printed by the at least one printing mechanism 03 are guided or at least can be guided through a chamber 23 of this drying unit 22, wherein an atmosphere that is oxygen-reduced by an inert gas is provided in the chamber 23 of the drying unit 22, wherein the chamber 23 of the drying unit 22 surrounds at least one arc section of a cylinder 04; 06; 36; 37; 38 transporting the substrates 21 to be dried, wherein this cylinder 04; 06; 36; 37; 38 is formed without a gripper.

A particular embodiment variant is e.g. a rotation printing machine having at least one printing mechanism 03 for printing substrates 21, wherein a drying unit 22 is provided in or after the at least one printing mechanism 03 in the transport path of the substrates 21, wherein substrates 21 printed by the at least one printing mechanism 03 are guided or at least can be guided through a chamber 23 of this drying unit 22, wherein an atmosphere that is oxygen-reduced by an inert gas is provided in the chamber 23 of the drying unit 22, wherein several suction rollers 48 are arranged in the chamber 23 of the drying unit 22 along the transport path of the substrates 21, wherein the suction rollers 48 convey the substrates 21 through this chamber 23 by their respective rotation.

A concrete embodiment variant is also given e.g. by a sheet printing machine having at least one printing mechanism 03 for printing printed sheets 21, wherein a drying unit 22 is provided in or after the at least one printing mechanism 03 in the transport path of the printed sheets 21, wherein printed sheets 21 printed by the at least one printing mechanism 03 are guided or at least can be guided through a chamber 23 of this drying unit 22, wherein an atmosphere that is oxygen-reduced by an inert gas is provided in the chamber 23 of the drying unit 22, wherein the drying unit 22 has an electron beam generator 28 for drying the printed printing sheets 21 by means of an electron beam directed into the chamber 23, wherein the atmosphere in the chamber 23 of the drying unit 22 has an oxygen amount of at most 1%.

Furthermore, e.g. a sheet gravure printing machine having at least one printing mechanism 03 for printing sheets 21 emerges, wherein a printing cylinder 04 and a plate cylinder 06 interacting with this printing cylinder 04 are arranged in the relevant printing mechanism 03, wherein a wiping cylinder 07 activated or at least being able to be set against the plate cylinder 06 is provided, wherein a drying unit 22 is provided in or after the at least one printing mechanism 03 in the transport path of the printed sheets 21, wherein printing sheets 21 printed by the at least one printing mechanism 03 are guided or at least can be guided through a chamber 23 of this drying unit 22, wherein the drying unit 22 has an electron beam generator 28 for drying the printed printing sheets 21 by means of an electron beam directed into the chamber 23.

Further embodiments and/or developments of the printing machines mentioned above emerge by means of any meaningful and thus consistent combination of the features described above by way of example.

FIG. 9 now shows another embodiment variant which is suitable, in particular, for retrofitting in a printing machine. This embodiment variant relates to a drying unit 22 for drying printed substrates 21, preferably respectively formed as printing sheets 21, having a chamber 23 containing a gaseous medium, wherein the gaseous medium contained in the chamber 23 is oxygen-reduced by means of an inert gas. In the preferred embodiment, this drying unit 22 forms an individual component which can also be retrospectively introduced, in particular, into a printing machine in the transport path of the printed substrates 21. The substrates 21 to be dried are guided or at least can be guided through the chamber 23 of this drying unit 22. In the transport direction T of the substrates 21, the chamber 23 has an entrance that is preferably formed as a slot and extends transversely to the transport direction T of the substrate 21 for the substrates 21 to be guided into this chamber 23, wherein the entrance for substrates 21 to be guided into the chamber 23 is formed by a roller gap 17 between two cylinders 04; 06 that are, in particular, respectively set against one another longitudinally under high pressure. The respective rotational direction of these two cylinders is indicated in FIG. 9 in each case by a rotational direction arrow. Advantageously, the two cylinders 04; 06 set against each other form, at this entrance, a seal against a leakage of the gaseous medium that is oxygen reduced, in particular of inert gas, out of this chamber 23 and/or against an occurrence of oxygen from the ambient air into this chamber 23. Preferably, an electron beam generator 28 having an electron beam directed in the chamber 23 onto the substrates 21 is provided in the drying unit 22 for drying the printed substrates 21. In particular with the final design in connection with an electron beam generator 28, the atmosphere, i.e. the gaseous medium in the chamber 23—as already described above—has an oxygen amount of at most 1%. However, in the transport direction of the substrates 21, the chamber 23 of this drying unit 22 also has an exit, in turn preferably formed as a slot and extending transversely to the transport direction T of the substrates 21, for the substrates 21 guided through this chamber 23, wherein a flexible seal 34 and/or a doctor blade 24 is or are arranged at this exit as a seal respectively against a leakage of the oxygen-reduced gaseous medium, in particular of an inert gas, out of this chamber 23 and/or against an occurrence of oxygen from the ambient air into this chamber 23.

In an advantageous development, the two cylinders 04; 06 set against each other form a printing mechanism 03 at the entrance of the chamber 23, wherein one of the cylinders 04 is formed as a printing cylinder 04 and the other cylinder 06 as a plate cylinder 06 interacting with the printing cylinder 04 and applying a printed image to the relevant substrates 21. Here, the printing mechanism 03 formed at the entrance of the chamber 23 of the drying unit 22 is formed e.g. as a printing mechanism 03 printing in a gravure printing method, in particular in an intaglio printing method.

Advantageously, a transportation device 16 is provided, wherein the transportation device 16 is arranged to guide the substrates 21 through the chamber 23, wherein the transportation device 16 is formed as a preferably peripheral transportation strip or a preferably peripheral chain system, in particular as a chain gripper system. It can also be provided that at least one of the two cylinders 04; 06 set against each other at the entrance of the chamber 23 is formed as a suction cylinder. Alternatively or additionally, in a channel 51 extending transversely to the transport direction T of the substrates 21, e.g. at least one of the two cylinders 04; 06 set against each other at the entrance of the chamber 23 has at least one gripper for holding one of the substrates 21 on the outer surface of the relevant cylinder 04; 06. Here, the relevant channel 51 is preferably covered with a cover, wherein the cover has a recess at the position of the relevant gripper.

LIST OF REFERENCE NUMERALS

01 Sheet feeder
02 Sheet feed
03 Printing mechanism
04 Printing cylinder; cylinder
05 -
06 Plate cylinder; cylinder
07 Wiping cylinder
08 Collecting cylinder; Orlof cylinder
09 Ink train unit
10 -
11 Template cylinder
12 Colour application roller
13 Ink duct roller
14 Ink reservoir
15 -
16 Transportation device
17 Printing gap; roller gap
18 Delivery; sheet delivery
19 Inspection system
20 -
21 Substrate; printing sheet
22 Drying unit

23 Chamber filled with an inert gas
24 Doctor blade nozzle
25 -
26 Filling nozzle
27 Sensor for measuring oxygen
28 Electron beam generator
29 Vacuum chamber
30 -
31 Seal
32 Cathode
33 Anode
34 Seal
35 -
36 Intermediary cylinder
37 Intermediary cylinder
38 Suction cylinder
39 Suction strip
40 -
41 Suction box
42 Suction strip
43 Suction box
44 Pump
45 -
46 Tank
47 Pump
48 Suction roller
49 Housing
50 -
51 Channel; groove
T Transport direction

The invention claimed is:

1. A drying unit for drying printed substrates, the drying unit comprising:

a chamber configured to hold a gaseous medium that is oxygen-reduced by an inert gas; and a pair of cylinders longitudinally positioned against each other and forming an entrance of the chamber, the pair of cylinders forming a printing mechanism, wherein one of the cylinders is a printing cylinder and the other cylinder is a cylinder configured to interact with the printing cylinder, the other cylinder being configured to apply a printed image to the substrates, wherein the pair of cylinders are configured to guide the substrates into the chamber in a transport direction of the substrates, wherein the chamber is configured to guide the substrates through the chamber, wherein the chamber surrounds an arc section of each of the pair of cylinders, wherein the pair of cylinders are pressed against each other to form a first seal running axially to the pair of cylinders against a leakage of the oxygen-reduced gaseous medium out of the chamber and/or against an infiltration of oxygen from the ambient air into the chamber at the entrance of the chamber, and wherein the printing mechanism arranged at the entrance of the chamber is configured to print in a gravure printing process.

2. A drying unit according to claim 1, further comprising a second seal against a leakage of the oxygen-reduced gaseous medium out of the chamber and/or against an infiltration of oxygen from the ambient air into the chamber, wherein the chamber has an exit for the substrates guided through the chamber in the transport direction of the substrates, wherein the second seal is arranged at the exit, and wherein the second seal is a flexible seal or a doctor blade nozzle.

3. A drying unit according to claim 2, wherein the exit for the substrates guided through the chamber is a slot extending transversely to the transport direction of the substrates across the entire width of the substrates.

4. A drying unit according to claim 3, wherein the doctor blade nozzle is in the form of a nozzle beam extending longitudinally to the slot-shaped exit of the chamber.

5. A drying unit according to claim 1, further comprising an electron beam generator configured to direct an electron beam onto the substrates in the chamber to dry the printed substrates.

6. A drying unit according to claim 1, further comprising the oxygen-reduced gaseous medium, and wherein the oxygen-reduced gaseous medium in the chamber has an oxygen amount of at most 1% and/or the inert gas in the chamber of the drying unit is an elemental gas or a noble gas or a gaseous molecular compound.

7. A drying unit according to claim 1, wherein the other cylinder interacting with the printing cylinder is formed as a plate cylinder, and wherein the printing cylinder and the plate cylinder are respectively produced from steel.

8. A drying unit according to claim 7, further comprising a wiping cylinder that is positioned against the plate cylinder, wherein the wiping cylinder is coated with a plastic on its outer surface.

9. A drying unit according to claim 7, further comprising:

an Orlof-type cylinder positioned against the plate cylinder, and a plurality of template cylinders, wherein the plurality of template cylinders of an ink train unit are positioned against the Orlof-type cylinder.

10. A drying unit according to claim 7, wherein the printing cylinder is formed without a gripper.

11. A drying unit according to claim 1, wherein at least one of the pair of cylinders is formed as a suction cylinder and comprises a sucker configured to hold the substrate on the outer surface of the suction cylinder.

12. A drying unit according to claim 1, wherein at least one of the pair of cylinders has at least one gripper configured to hold one of the substrates on the outer surface of the respective cylinder, and wherein the gripper is placed in a groove extending transversely to the transport direction of the substrates.

13. A drying unit according to claim 1, wherein the printing mechanism arranged at the entrance of the chamber is configured to print in an intaglio printing process.

* * * * *